US006841952B1

(12) United States Patent
Lee

(10) Patent No.: US 6,841,952 B1
(45) Date of Patent: Jan. 11, 2005

(54) ELECTRONIC STABILIZER

(76) Inventor: Ching-Chung Lee, No. 55-3, Lane 904, Chung-Shan Rd., Tao-Yuan City (TW)

( * ) Notice: Subject to any disclaimer, the term of this patent is extended or adjusted under 35 U.S.C. 154(b) by 0 days.

(21) Appl. No.: 10/651,070

(22) Filed: Aug. 29, 2003

(51) Int. Cl.[7] ..... G05F 1/00

(52) U.S. Cl. ..... 315/291; 315/282; 315/276; 315/71; 315/224

(58) Field of Search ..... 315/209 R, 307, 315/362, 291, 294, 276, 282, 94, 224, 312, DIG. 7, 70, 71

(56) References Cited

U.S. PATENT DOCUMENTS 4,207,497 A * 6/1980 Capewell et al. ..... 315/96
4,508,996 A * 4/1985 Clegg et al. ..... 315/224
4,994,717 A * 2/1991 Moon ..... 315/219
5,402,043 A * 3/1995 Nilssen ..... 315/307
5,500,792 A * 3/1996 Jeon et al. ..... 363/98
6,362,575 B1 * 3/2002 Chang et al. ..... 315/224

* cited by examiner

*Primary Examiner*—Haissa Philogene
(74) *Attorney, Agent, or Firm*—Harrison & Egbert

(57) ABSTRACT

An electronic stabilizer includes a high frequency output transformer which is connected in a primary side with a frequency modulation/power amplifying circuit, and in a secondary side with a plurality of high frequency ballasts and capacitors. The ballasts and the capacitors are matched in accordance with voltage and current of a plurality of lamps without affecting the frequency modulation/power amplifying circuit. The high frequency output transformer is capable of adjusting to output a desired voltage.

1 Claim, 5 Drawing Sheets

ELECTRONIC STABILIZER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to an electronic stabilizer comprising a high frequency output transformer, a frequency modulation/power amplifying circuit, a plurality of high frequency ballasts, and a plurality of capacitors. The electronic stabilizer is adapted to a circuit of discharge lamps of various forms such that the temperature build-up of the circuit is minimized, and that the lighting of the discharge lamps is stabilized.

BACKGROUND OF THE INVENTION

As shown in FIG. 5, an electronic stabilizer of the prior art comprises a frequency modulation circuit which is serially connected with an electro induction L2 and a constant current lighting. The lamp is regarded as one of the component parts of the circuit. In the event that the lamp is changed in one way or another, the circuit is bound to react poorly. In light of the circuit voltage being limited by the power source voltage, the circuit is limited in design in that it allows only a limited number of lamps to be connected thereto.

BRIEF SUMMARY OF THE INVENTION

The primary objective of the present invention is to provide an electronic stabilizer which is free of the deficiencies of the prior art electronic stabilizer described above.

In keeping with the principle of the present invention, the foregoing objective of the present invention is attained by the electronic stabilizer comprising a high frequency output transformer, a frequency modulation/power amplifying circuit, a plurality of high frequency ballasts, and a plurality of capacitors. The primary side of the high frequency output transformer is connected with the frequency modulation/power amplifying circuit, whereas the secondary side of the high frequency output transformer is connected with the high frequency ballasts and the capacitors (IC and MOSFET). The high frequency output transformer is a main load, with its oscillation frequency being determined by IC. The present invention is characterized by the high frequency output transformer which is electrically matched with the lamps to be lighted. The load matching of the high frequency output transformer is associated with the characteristics of the lamp voltage and the lamp current of the load lamps. The present invention is different from the prior art electronic stabilizer in the output power lamp load, which is a high frequency transformer, and in the absence of direct current (DC). As a result, the lamps and the high frequency ballasts may be either coupled or separated. The high frequency output transformer of the present invention is merely a voltage transformer, by means of which a desired output voltage can be adjusted. The present invention is therefore adapted to the lighting of a plurality of lamps of the same kind or different kinds by virtue of the high frequency output transformer.

The features and the advantages of the present invention will be more readily understood upon a thoughtful deliberation of the following detailed description of a preferred embodiment of the present invention in reference to the accompanying drawings.

DETAILED DESCRIPTION OF THE INVENTION

Figure 1:
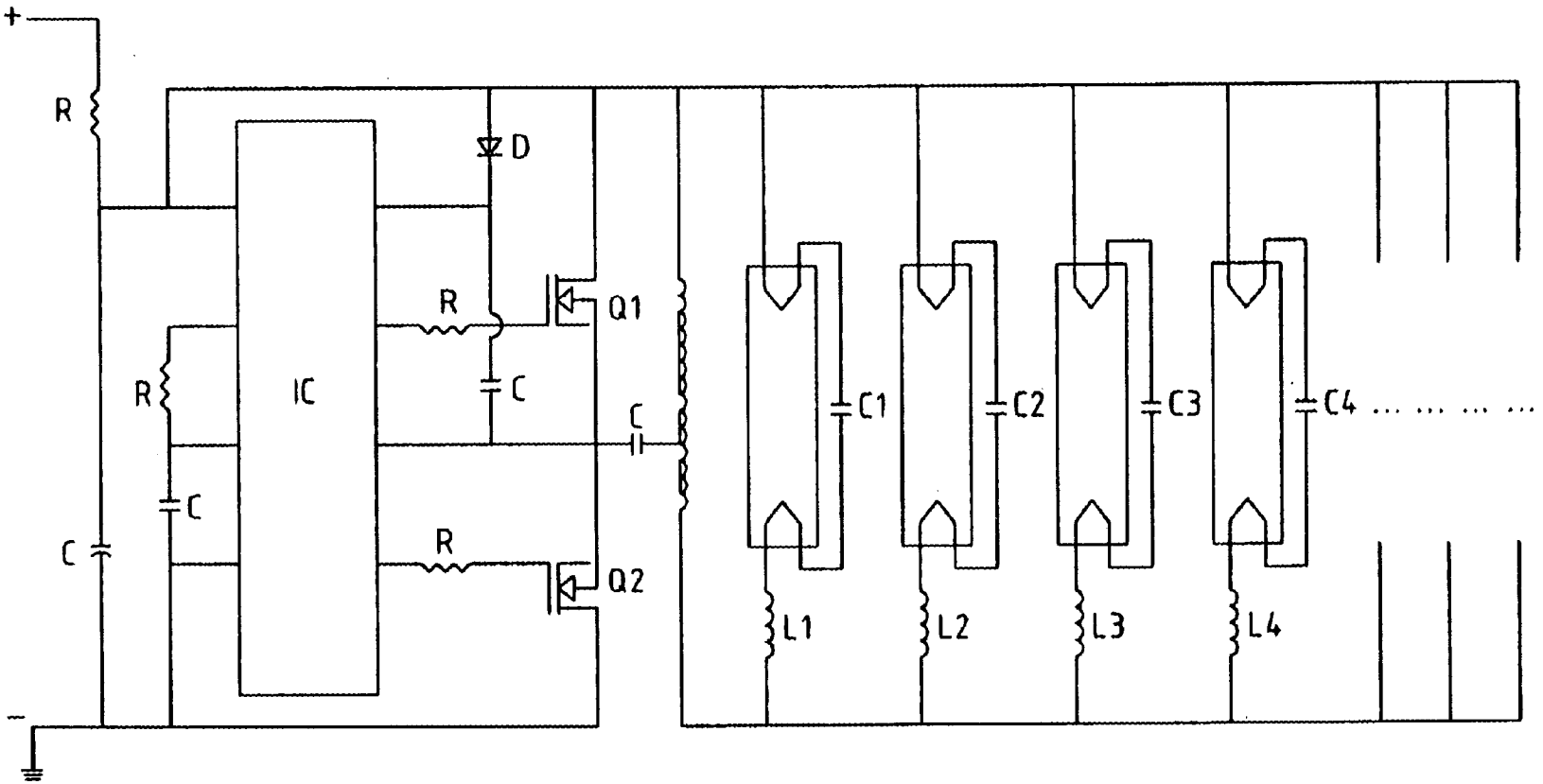
FIG. 1 shows a circuit diagram of the preferred embodiment of the present invention.
Figure 4:
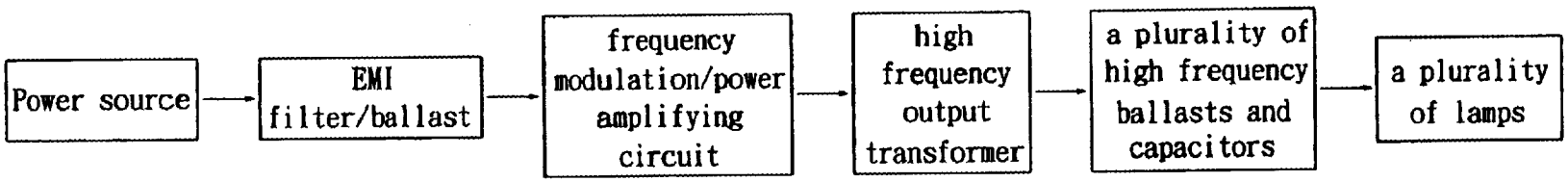
FIG. 4 shows a block diagram of the preferred embodiment of the present invention.
Figure 5:
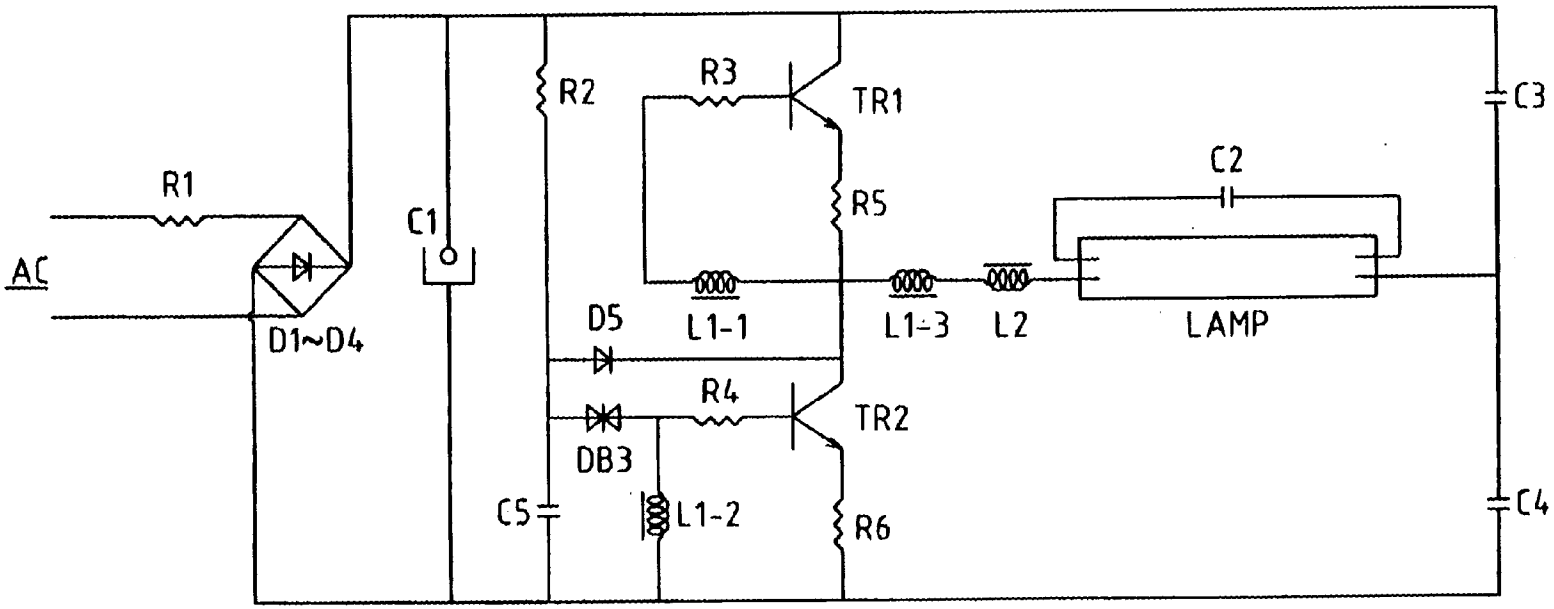
FIG.5 PRIOR ART
FIG. 5 shows a circuit diagram of an electronic stabilizer of the prior art.

As shown in FIGS. 1 and 4, an electronic stabilizer of the present invention comprises a high frequency output transformer, a frequency modulation/power amplifying circuit, and a plurality of high frequency ballasts and capacitors. The high frequency output transformer is connected in a primary side with the frequency modulation/power amplifying circuit, and in a secondary side with the high frequency ballasts and capacitors (IC and MOSFET). The high frequency output transformer is a main load, with its oscillation frequency being determined by IC. The only consideration of the high frequency output transformer is the electricity matching of the lamps to be lighted. The load matching is done with the characteristics of voltage and current of the load lamps. The present invention is different from the prior art electronic stabilizer in the output power lamp load, which is a high frequency transformer, and in the absence of direct current (DC). As a result, the lamps and the high frequency ballasts of the present invention may be either coupled or separated. The high frequency output transformer of the present invention is merely a voltage transformer, by which a desired output voltage is adjusted. The present invention is therefore suitable for use in lighting up a plurality of lamps of the same kind or different kinds by virtue of the high frequency output transformer.

Figure 2:
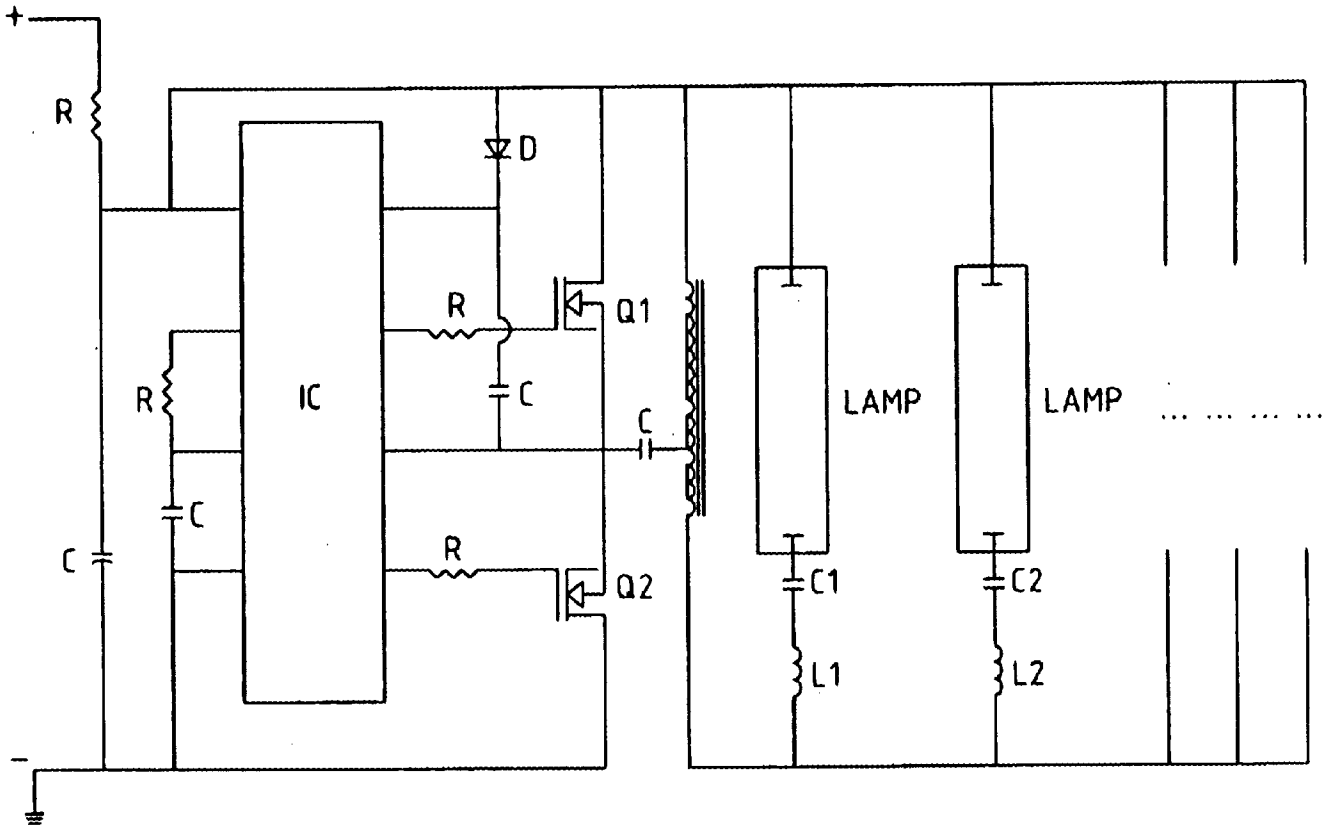
FIG. 2 shows another circuit diagram of the preferred embodiment of the present invention.

As shown in FIG. 2, the high frequency ballasts L1 and the capacitors C1 are serially connected to effect a lighting voltage to light up the lamps, with the internal impedance of the capacitors C1 being much greater than that of the lamps. The current of the lamps is controlled and stabilized by the high frequency ballasts L1.

With the electronic stabilizer of the present invention, the high frequency voltage and current can be adjusted at will to match the load of the lamps. In addition, the circuit of the present invention is designed to work with a fixed frequency and a fixed voltage. The output transistors of the power amplifying circuit of the present invention are serially connected. The output transistors of the power amplifying circuit of the present invention are either MOSF transistors or bipolar transistors. Without making use of the transistors resistant to high voltage, the present invention can be easily designed to match freely a plurality of secondary discharge light-emitting bodies of various powers and types. Moreover, the high frequency ballasts and the capacitors can be serially connected, as shown in FIG. 2.

Figure 3:
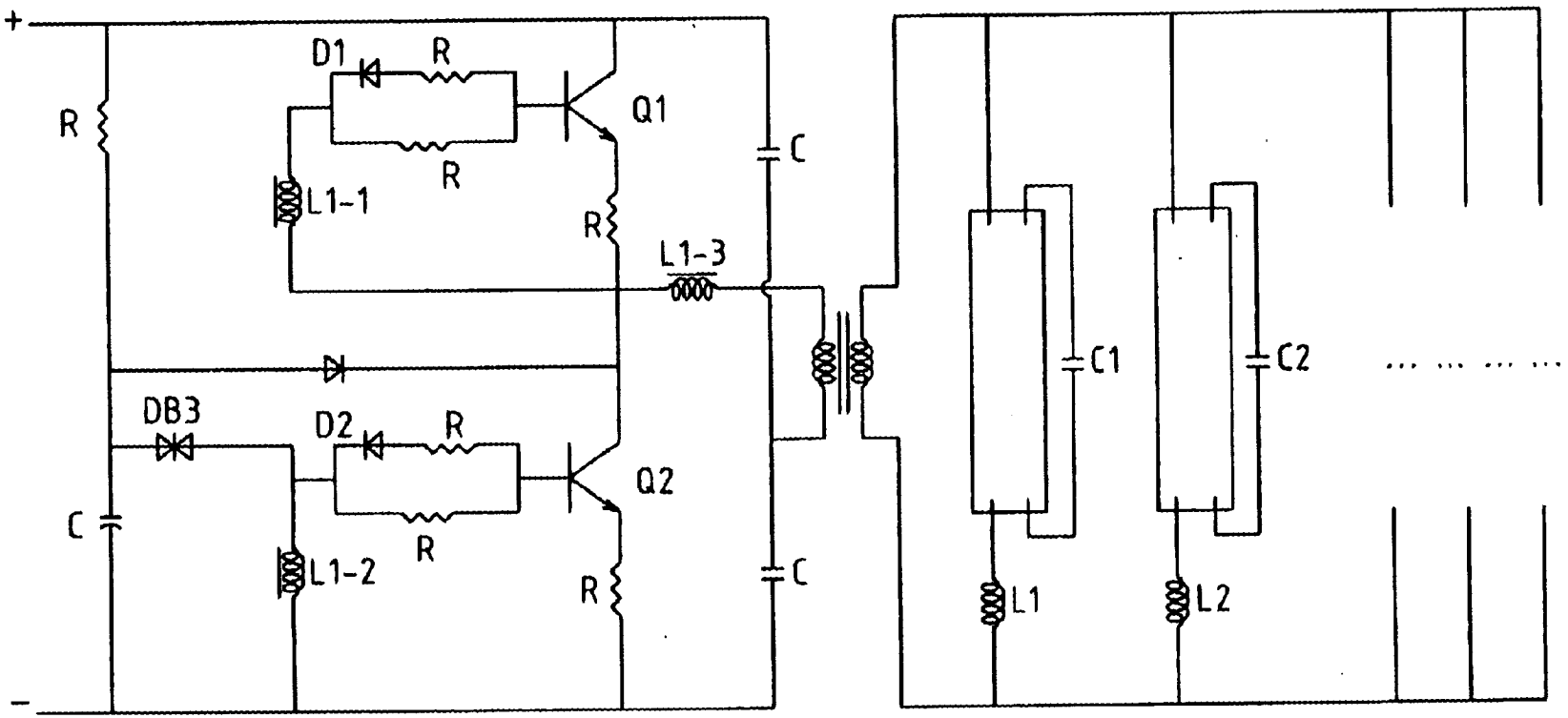
FIG. 3 shows still another circuit diagram of the preferred embodiment of the present invention.

As shown in FIG. 3, the power amplifying circuit of the present invention comprises a plurality of bipolar transistors, and two Schottky diodes D1 and D2. As a result, the bipolar transistors are prevented from being heated.

The present invention is further different from the prior art in design in that the latter makes use of a constant voltage fighting circuit, which calls for a voltage increment three times greater than the lamp voltage. In addition, the output transformer remains in a high potential in the wake of the lighting of the lamp. As a result, the output transformer can not be easily dealt with.

In light of the high frequency ballasts and the capacitors of the present invention being connected in series, the capacitors provide the lamps with a sufficient electric current by which the filament of the lamps becomes incandescent. The lamps are lighted up by a high frequency voltage which is brought about at the time when the high frequency ballasts and the capacitors are engaged in a harmonic oscillation. Upon being lighted up, the lamps have a low internal impedance, thereby allowing the passage of the electric current. The high frequency ballast serves as a high frequency current regulator enabling the lamp to be lighted normally. With cooperation of the high frequency output transformer, the high frequency ballasts, and the capacitors, any secondary discharge lamps, such as HID, HQI internal lamp, fluorescent lamp, etc., can be matched.

The advantages of the present invention over the prior art are therefore readily apparent. In the first place, the power amplifying circuit of the primary side of the present invention is not affected in any way in a situation in which a plurality of lamps of various voltages and currents are lighted. The output transformer of the present invention can be adjusted at will to output a desired voltage. The prior art electronic stabilizer is incapable of attaining such a deed.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claim.

What is claimed is:

1. An electronic stabilizer comprising a high frequency output transformer, a frequency modulation/power amplifying circuit, and a plurality of high frequency ballasts and a plurality of capacitors;

wherein said high frequency output transformer is connected in a primary side with said frequency modulation/power amplifying circuit, and in a secondary side with said high frequency ballasts and said capacitors whereby said high frequency ballasts and said capacitors are matched in accordance with voltage and current of said plurality of lamps, without affecting said frequency modulation/power amplifying circuit, thereby enabling said high frequency output transformer to adjust to output a desired voltage.

* * * * *